US006528241B1

(12) United States Patent
Szajewski

(10) Patent No.: US 6,528,241 B1
(45) Date of Patent: Mar. 4, 2003

(54) COLOR PHOTOGRAPHIC ELEMENT COMPRISING A MULTIFUNCTIONAL INFRARED-DYE-FORMING COUPLER

(75) Inventor: Richard P. Szajewski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 12 days.

(21) Appl. No.: 09/928,602

(22) Filed: Aug. 13, 2001

(51) Int. Cl.[7] ..... G03C 7/46

(52) U.S. Cl. ..... 430/376; 430/363; 430/385; 430/503; 430/543; 430/555; 430/944; 430/955; 430/959; 430/566

(58) Field of Search ..... 430/502, 503, 430/543, 553, 944, 955, 959, 566, 376, 385, 363

(56) References Cited

U.S. PATENT DOCUMENTS 5,248,739 A 9/1993 Schmidt et al.
5,415,981 A 5/1995 Clarke et al.
5,756,269 A 5/1998 Ishikawa et al.
6,143,693 A * 11/2000 Irving et al. ..... 503/201
6,197,722 B1 * 3/2001 Irving et al. ..... 503/201
6,200,738 B1 3/2001 Takano et al.
6,440,896 B1 * 8/2002 Szajewski et al. ..... 503/201

FOREIGN PATENT DOCUMENTS

JP 133947 A 5/2001

* cited by examiner

*Primary Examiner*—Geraldine Letscher
(74) *Attorney, Agent, or Firm*—Chris P. Konkol

(57) ABSTRACT

A light-sensitive silver-halide color photographic element comprising a multifunctional coupler enabling formation of an infrared dye on development, wherein the multifunctional coupler has the property that it is capable of forming a distinctly colored cyan dye with an oxidized form of the developer 4-(N-ethyl-N-2-hydroxyethyl)-2-methylphenylenediamine.

27 Claims, No Drawings

COLOR PHOTOGRAPHIC ELEMENT COMPRISING A MULTIFUNCTIONAL INFRARED-DYE-FORMING COUPLER

FIELD OF THE INVENTION

The present invention is directed to a color photographic element comprising a multifunctional coupler in association with a developer enabling formation of an infrared color imaging dye, wherein the coupler has the property that it forms a distinctly colored dye with a different developer.

BACKGROUND OF THE INVENTION

U.S. Pat. No. 5,756,269 to Ishikawa et al. discloses the combination of three different developers with three different couplers. For example, a coupler "Y- 1" is used with a hydrazide developing agent to form a yellow dye. Ishikawa et al. does not mention, nor attach any significance to, the fact that the same coupler is a magenta dye-forming coupler if used with a common phenylenediamine developing agent.

Clarke et al., in U.S. Pat. Nos. 5,415,981 and 5,248,739, showed that azo dyes formed from a blocked hydrazide developer are shifted to shorter wavelengths. This is perhaps not surprising since azo dyes derived from "magenta couplers" are known to be typically yellow and are used as masking couplers. The substitution pattern on the masking coupler is such that it can undergo further reaction with the oxidized form of a paraphenylene diamine developer to form a magenta dye.

Infrared dyes are used in the photographic area for certain applications. For example, motion picture soundtracks are typically an optically encoded signal that can be read by an infrared detector during projection. In many instances, this signal is encoded by developed metallic silver. However, some applications use and infrared dye for this signal so that the soundtrack can be developed in a chromogenic photographic developing process. The sound track technology is described by: Ciurca, et al. U.S. Pat. No. 4,178,183; Sakai, et al., U.S. Pat. No. 4,208,210, Osborn, et al., U.S. Pat. No. 4,250,251; Fernandez, et al., U.S. Pat. No. 4,233,389; Monbaliu, et al., U.S. Pat. No. 4,839,267 and Olbrecht, et al. U.S. Pat. Nos. 5,030,544 and 5,688,959. Hawkins, et al. in U.S. Pat. No. 5,842,063 describes the use of non-visible color layers to carry collateral information such as sound or metadata in still pictorial images.

Takano, et al., in U.S. Pat. No. 6,200,738 describes the infrared scanning of developed and only partially desilvered conventional color films. In this approach, the infrared scanning signal is employed to identify the location of silver particles and the R, G, B scanned signal is digitally corrected for these defects. This procedure leads to reduced noise in the final image along with a concomitant loss of resolution because of the massive number of image interpolations employed. Accordingly, the approach is far from satisfactory.

None of these patents relate to the use of infrared dye-forming couplers, as one of three color channels, for the purpose of forming a color image by means of scanning without removing all of the silver in the film.

PROBLEM TO BE SOLVED BY THE PRESENT INVENTION

It has become desirable to limit the amount of solvent or processing chemicals used in the processing of silver-halide films. A traditional photographic processing scheme for color film involves development, fixing, bleaching, and washing, each step typically involving immersion in a tank holding the necessary chemical solution. Images are then produced by optical printing. By scanning the film image following development, some of the processing solutions subsequent to development could be eliminated for the purposes of obtaining a color image. Instead, the scanned image could be used to directly provide the final image to the consumer.

By the use of photothermographic film, it would be possible to eliminate processing solutions altogether, or alternatively, to minimize the amount of processing solutions and the complex chemicals contained therein. A photothermographic (PTG) film by definition is a film that requires energy, typically heat, to effectuate development. A dry PTG film requires only heat; a solution-minimized PTG film may require small amounts of aqueous alkaline solution to effectuate development, which amounts may be only that required to swell the film without excess solution. Development is the process whereby silver ion is reduced to metallic silver and, in a color system, a dye is created in an image-wise fashion.

In PTG films, the silver metal and silver halide is typically retained in the coating after the heat development. It can be difficult to scan through imagewise exposed and photoprocessed silver-halide films when the undeveloped silver halide is not removed from the film during processing. The retained silver halide is absorptive, scattering and reflective. All three appear as density in a scanner to the point, in high-silver films, of making the film unsuitable for scanning. High densities result in the introduction of Poisson noise into the electronic form of the scanned image, and this in turn results in decreased image quality. The Poisson noise problem can be attacked by increasing scan time or by increasing scanner illumination intensity. Increasing scan time is unsuitable in terms of throughput considerations and in terms of customer frustration. If, on the other hand, a scanner is designed with a more powerful light source in order to negate the effects of the film turbidity, scanner cost is increased. In addition, the high reflectivity of a retained silver film can cause reflection of light back in the light source of the scanner, which can degrade the uniformity of the scanner illumination system or cause increased flare. Further, the retained silver and silver halide scatter light thus decreasing the sharpness of the formed image.

It is therefore an object of the present invention to improve the scanning of photothermographic film without removing the silver halide and/or metallic silver, or partially removing the same.

SUMMARY OF THE INVENTION

The present invention relates to a light sensitive color photographic imaging element comprising at least two different chromogenic couplers including, in reactive association, a multifunctional coupler and a developer precursor liberating a developing agent enabling formation of an infrared imaging dyefrom the multifunctional coupler on development, wherein the multifunctional coupler has the property that it is capable of forming at least one other distinctly colored cyan dye with an oxidized form of the conventional developer 4-(N-ethyl-N-2-hydroxyethyl)-2-methylphenylenediamine. The latter developer (also known as "CD2"), which developer is widely used, is used herein as a standard means for the purpose of enabling a convenient color comparison, but other developers could have been substituted instead.

In a preferred embodiment, the light-sensitive silver-halide color photographic element has a red-light-sensitive silver-halide layer unit and a first blocked coupling developer, a green-light-sensitive silver-halide layer unit and a second blocked coupling developer, and a blue-light-sensitive silver-halide layer unit having a third blocked coupling developer, wherein at least one layer unit, or imaging layer in the layer unit, has a multifunctional coupler according to the present invention. The blocked developer can be different or the same in the different layer units, and the coupler can be different or the same in the different layer units.

DETAILED DESCRIPTION OF THE INVENTION

As mentioned above, the invention relates to a light-sensitive color photographic imaging element comprising at least two different chromogenic couplers including, in reactive association, a multifunctional coupler and a developer precursor that liberates a developing agent enabling formation of an infrared imaging dye from the multifunctional coupler on development, wherein the multifunctional coupler has the property that it is capable of forming at least one other distinctly colored dye with an oxidized form of the conventional developer 4-(N-ethyl-N-2-hydroxyethyl)-2-methylphenylenediamine. The developer precursor can liberates a phenylenediamine type of developer or an aminophenol type of developer, as described in more detail below.

The invention encompasses the possible use of one or more different couplers and one or more developing agents in the same imaging element. For example, there can be two different couplers, three different couplers in the imaging element, or a common chromogenic coupler, the latter embodiment being disclosed in commonly assigned co-pending Ser. No. 09/871,310 hereby incorporated by reference. It is possible to have more than three couplers, per the Japanese kokai mentioned above. It is also possible to have more than three different developers (or blocked developers), three different developers (or blocked developers), two different developers (or blocked developers), or a single developer (or blocked developer).

In one embodiment of the present invention, a light-sensitive color photothermographic element comprises at least one blue light-sensitive layer or unit comprising a magenta dye-forming coupler, at least one green light sensitive layer or unit having a cyan dye forming coupler and at least one red light-sensitive layer having an infrared dye-forming coupler. This can be accomplished by employing conventional yellow, magenta and cyan dye forming couplers in combination with a hue shifting developing agent, for example, of the paraphenylene diamine type. These are typically 2,5-dialkyl-4-N, N-dialkylaminoanilines.

A color recording layer unit ("unit" or "color unit") can comprise one or more imaging layers, for example, three imaging layers, which layers are sensitive to the same color. Thus, any one or all of the imaging layers in a color unit can comprise an infrared dye-forming coupler.

Other permutations of color image forming dyes are possible. For example, it is also possible to have two infrared dye-forming layer units in combination with a colored dye-forming layer unit. For example, in another embodiment of the present invention, a light-sensitive photothermographic color element comprises a (at least one) blue light-sensitive layer or unit comprising a cyan dye-forming coupler, a green light-sensitive layer or unit comprising a near infrared dye-forming coupler, and a red light-sensitive layer or unit having a far infrared dye forming coupler. This can be accomplished by using art known magenta, cyan and infrared dye forming couplers in combination with a hue shifting paraphenylene diamine developer, typically 2,5-dialkyl-4-N, N-dialkylaminoanilines.

In a preferred variant, the element is a photothermographic element. In this embodiment, an imagewise exposed element is developed by heat treatment. In another variant of the first embodiment, an imagewise exposed element is developed by treatment with base either by contacting the element to a pH controlling solution or by contacting the element to a pH controlling laminate.

In yet another embodiment, the element is developed by treatment with a hue shifting color developer delivered in solution, by immersion or spraying for example, or from a laminate.

The chromogenic coupler is referred to herein as a multifunctional coupler ("MFC"), by which is meant that the coupler has the property of forming different color dyes with the oxidized forms of distinct color developers. In one embodiment, the same coupler can form two different colors, preferably cyan and infrared.

The multifunctional dye forming coupler can be any known coupler, or modification, variation, or derivative thereof, that possesses the requisite property of forming different color dyes with the oxidized forms of distinct color developers. Most generally, such a coupler will have Structure I:

(I)

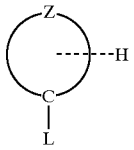

wherein:

C is a carbon atom at which coupling occurs;

L represents a hydrogen atom or a leaving group covalently bound to C and which is displaced on coupling;

H is an acidic hydrogen atom serving to direct coupling to C and which is covalently bound to C directly or by conjugation; and Z represents the remainder of the atoms of the coupler, in cyclic or acyclic form which together provide sufficient electron withdrawal to render H acidic and together provide sufficient ballast function to render the dye formed from the coupler immobile.

The coupler according to Structure I can be monomeric or polymeric in nature. Some couplers useful in the practice of this invention are described in *Research Disclosure*, Item 38957, Section X, Dye Image Formers and Modifiers, in *Research Disclosure*, Item 37038 (1995); in Katz and Fogel, *Photographic Analysis*, Morgan & Morgan, Hastings-on-Hudson, New York (1971), in the Appendix; and in Ikesu et al., in U.S. Pat. Nos. 5,658,720 and 5,679,506, the disclosures of which are all incorporated by reference.

As used herein and throughout the specification unless where specifically stated otherwise, the term "alkyl" refers to an unsaturated or saturated, straight or branched chain alkyl group, including alkenyl and aralkyl, and includes cyclic alkyl groups, including cycloalkenyl, and the term "aryl" includes specifically fused aryl.

When reference in this application is made to a particular moiety, or group, this means that the moiety may itself be unsubstituted or substituted with one or more substituents (up to the maximum possible number). For example, "alkyl" or "alkyl group" refers to a substituted or unsubstituted alkyl, while "aryl group" refers to a substituted or unsubstituted benzene (with up to five substituents) or higher aromatic systems. Generally, unless otherwise specifically stated, substituent groups usable on molecules herein include any groups, whether substituted or unsubstituted, which do not destroy properties necessary for the photographic utility of the compound, whether coupler utility or otherwise. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched, unbranched or cyclic.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. Generally, unless indicate otherwise, alkyl, aryl, and other carbon-containing groups and substituents thereof may include those having up to 48 carbon atoms, typically 1 to 36 carbon atoms and usually less than 24 carbon atoms, but greater numbers are possible depending on the particular substituents selected. For example, ballast groups for couplers will tend to have more carbon atoms than other groups on the coupler.

In a preferred embodiment of the invention, the coupler is a phenolic, naphtholic, or pyrrolotriazole compound. Such couplers are well known in the art and are described in such representative patents and publications as: U.S. Pat. Nos. 2,772,162; 3,476,563; 4,526,864; 4,500,635; 4,254,212; 4,296,200; 4,457,559; 2,895,826; 3,002,836; 3,034,892; 2,474,293; 2,801,171; 2,423,730; 2,367,531; 3,041,236; 4,443,536; 4,333,999; 4,124,396; 4,775,616; 3,779,763; 3,772,002; 3,419,390; 4,690,889; 3,996253 and "Farbkuppler-eine Literatureubersicht," published in Agfa Mitteinlungen, Band III, pp. 156–175 (1961), the disclosures of which are incorporated herein by reference. In one embodiment, the infrared dye-forming coupler comprises a phenol or naphthol compound that forms a infrared dye on reaction with an appropriate oxidized color developing agent. For example, the infrared dye-forming coupler may be a compound selected from the following formulae:

C-A

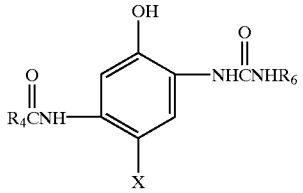

C-B

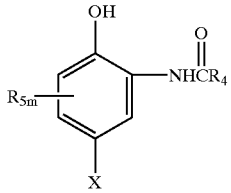

C-C

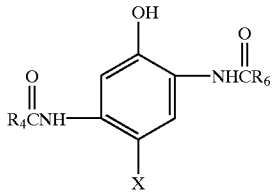

C-D

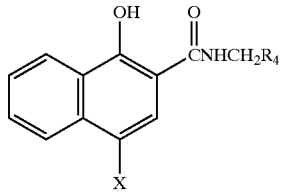

wherein $R_4$ is a ballast substituent having at least 10 carbon atoms or is a group which links to a polymer forming a so-called polymeric coupler. Ballast substituents include alkyl, substituted alkyl, aryl and substituted aryl groups. Each $R_5$ is individually selected from hydrogen, halogens (e.g., chloro, fluoro), alkyl groups of 1 to 4 carbon atoms and alkoxy groups of 1 to 4 carbon atoms, and m is from 1 to 3. $R_6$ is selected from the group consisting of substituted and unsubstituted alkyl and aryl groups wherein the substituents comprise one or more electron-withdrawing substituents, for example, cyano, halogen, methylsulfonyl or trifluoromethyl.

X is hydrogen or a coupling-off group. Coupling-off groups are well known to those skilled in the photographic art. Generally, such groups determine the equivalency of the coupler and modify the reactivity of the coupler. Coupling-off groups can also advantageously affect the layer in which the coupler is coated or other layers in the photographic material by performing, after release from the coupler, such functions as development inhibition, bleach acceleration, color correction, development acceleration and the like. Representative coupling-off groups include halogens (for example, chloro), alkoxy, aryloxy, alkylthio, arylthio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in U.S. Pat. Nos. 2,355,169; 3,227,551; 3,432,521; 3,476,563; 3,617,291; 3,880,661; 4,052,212 and 4,134,766, and in British Patent Nos. 1,466,728; 1,531,927; 1,533,039; 2,006,755A and 2,017,704A, the disclosures of which are incorporated herein by reference.

A coupler compound should be nondiffusable when incorporated in a photographic element. That is, the coupler compound should be of such a molecular size and configuration that it will exhibit substantially no diffusion from the layer in which it is coated. In order to ensure that the coupler compound is nondiffusable, the substituent R4 should contain at least 10 carbon atoms or should be a group which is linked to or forms part of a polymer chain.

Another type of infrared-dye forming coupler are pyrrolotriazoles according to the following structures (IV) to (VII):

(IV)

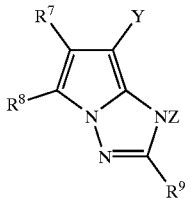

(V)

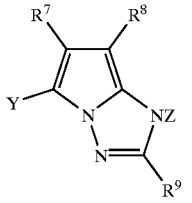

(VI)

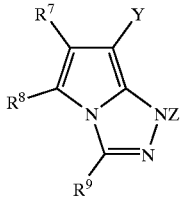

(VII)

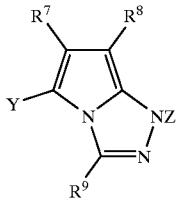

In general formulas (IV) to (VII), $R^7$, $R^8$ and $R^9$ each represents a hydrogen atom or a substituent group. The substituent groups represented by $R^7$, $R^8$ and $R^9$ include an alkyl group, an acyl group, a cyano group, a nitro group, an aryl group, a heterocyclic group, an alkoxycarbonyl group, an aryloxycarbonyl group, a carbamoyl group, a sulfamoyl group, an alkylsulfonyl group or an arylsulfonyl group, any of which may have a substituent group. The substituent groups which $R^7$, $R^8$ and $R^9$ may have include various substituent groups such as alkyl, cycloalkyl, alkenyl alkynyl, aryl, heterocyclic, alkoxyl, aryloxy, cyano, acylamino, sulfonamido, carbamoyl, sulfamoyl, alkoxycarbonyl, aryloxycarbonyl, alkylamino, arylamino, hydroxyl and sulfo groups and halogen atoms. Preferred examples of $R^7$, $R^8$ and $R^9$ include acyl, cyano, carbamoyl and alkoxycarbonyl groups.

The group Y is a hydrogen atom or a group which is removable by the coupling reaction with a developing agent oxidant. Examples of the groups represented by Y functioning as anionic removable groups of the 2-equivalent couplers include halogen atoms (for example, chlorine and bromine), an aryloxy group (for example, phenoxy, 4-cyanophenoxy or 4-alkoxycarbonylphenyl), an alkylthio group (for example, methylthio, ethylthio or butylthio), an arylthio group (for example, phenylthio or tolylthio), an alkylcarbamoyl group (for example, methyl-carbamoyl, dimethylcarbamoyl, ethylcarbamoyl, diethyl-carbamoyl, dibutylcarbamoyl, piperidylcarbamoyl or morpholyl-carbamoyl), an arylcarbamoyl group (for example, phenyl-carbamoyl, methylphenylcarbamoyl, ethylphenylcarbamoyl or benzylphenylcarbamoyl), a carbamoyl group, an alkyl-sulfamoyl group (for example, methylsulfamoyl, dimethylsulfamoyl, ethylsulfamoyl, diethylsulfamoyl, dibutylsulfamoyl, piperidylsulfamoyl or morpholylsulfamoyl), an arylsulfamoyl group (for example, phenylsulfamoyl, methylphenylsulfamoyl, ethylphenylsulfamoyl or benzylphenylsulfamoyl), a sulfamoyl group, a cyano group, an alkylsulfonyl group (for example, methanesulfonyl or ethanesulfonyl), an arylsulfonyl group (for example, phenylsulfonyl, 4-chlorophenylsulfonyl or p-toluenesulfonyl), an alkylcarbonyloxy group (for example, acetyloxy, propionyloxy or butyroyloxy), an aryl-carbonyloxy group (for example, benzoyloxy, tolyloxy or anisyloxy) and a nitrogen-containing heterocyclic group (for example, imidazolyl or benzotriazolyl).

The group Z represents a hydrogen atom or a group capable of being released upon color development. The group represented by Z includes the group capable of being released under an alkaline condition as described, for example, in JP-A-61-22844. Z is preferably a hydrogen atom.

Preferred examples of the pyrrolotriazole couplers represented by general Formulas (IV) to (VII) include couplers in each of which at least one of $R^7$ and $R^8$ is an electron attractive group, which are described in European Patents 488,248A1,491,197A1 and 545,300, hereby incorporated by reference.

Some examples of preferred multifunctional infrared dye-forming couplers include, but are not limited to, the following couplers:

Specific examples of infrared dye-forming couplers useful for the practice of this invention include, but are not limited to, compounds (c-i) to (c-xv) below, which represent species based on generic formulas C-A to C-D above:

(C-I)

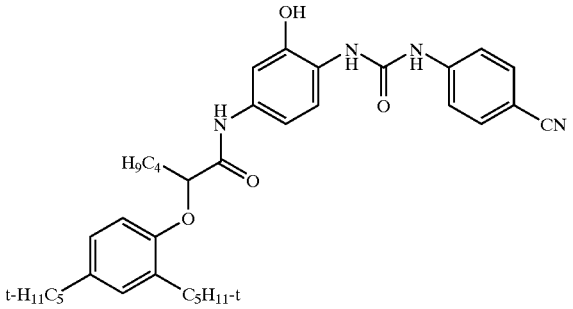

(C-II)

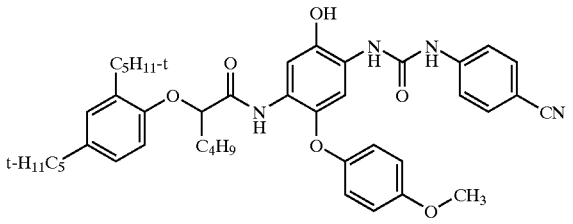

-continued
(C-III)
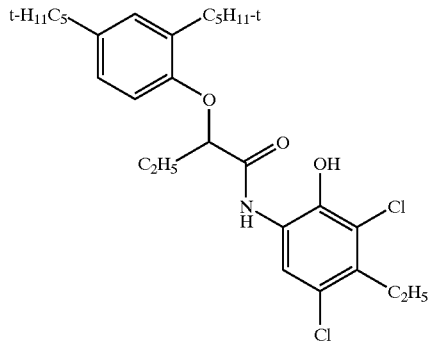
(C-IV)
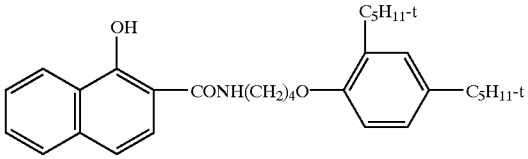
(C-V)
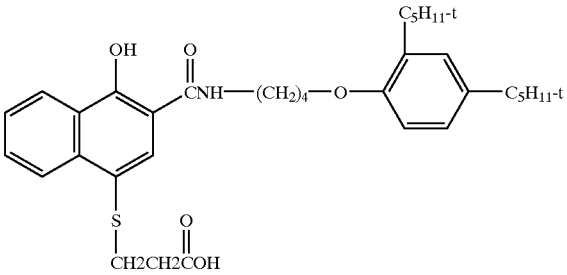
(C-VI)
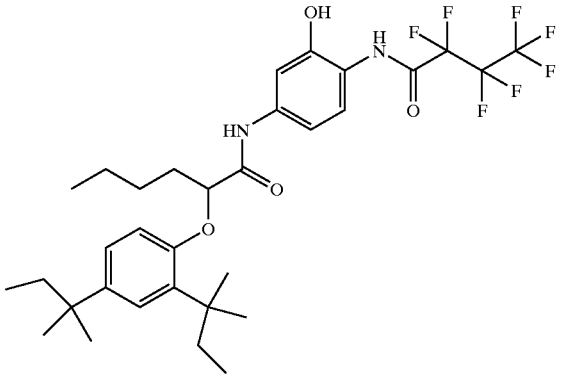
-continued
(C-VII)
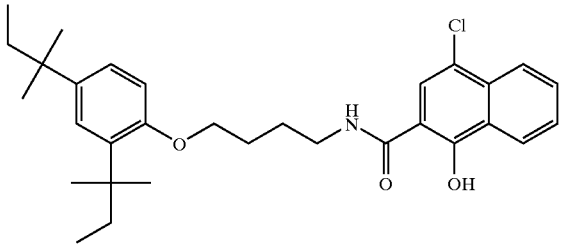
(C-VIII)
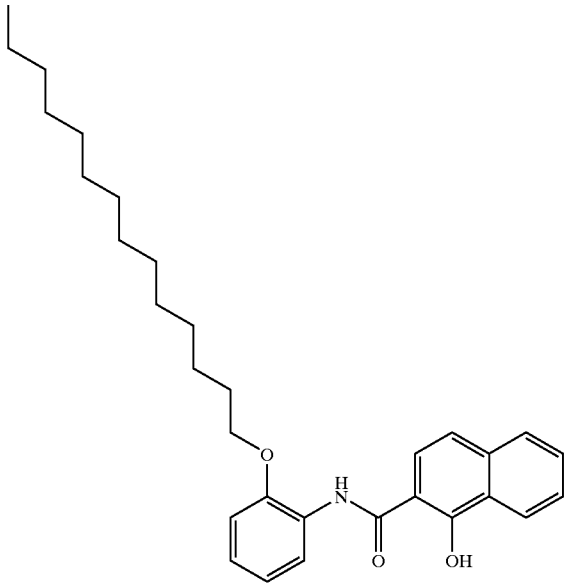
(C-IX)
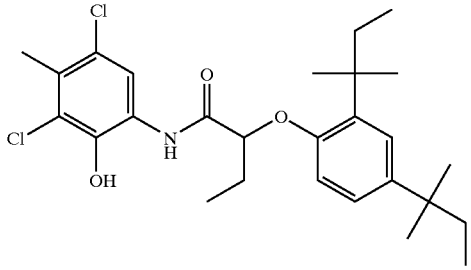
(C-X)
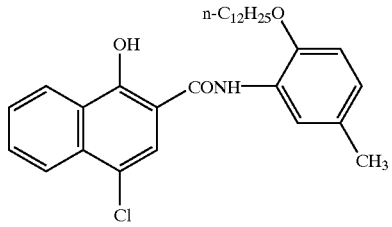

-continued
(C-XI)
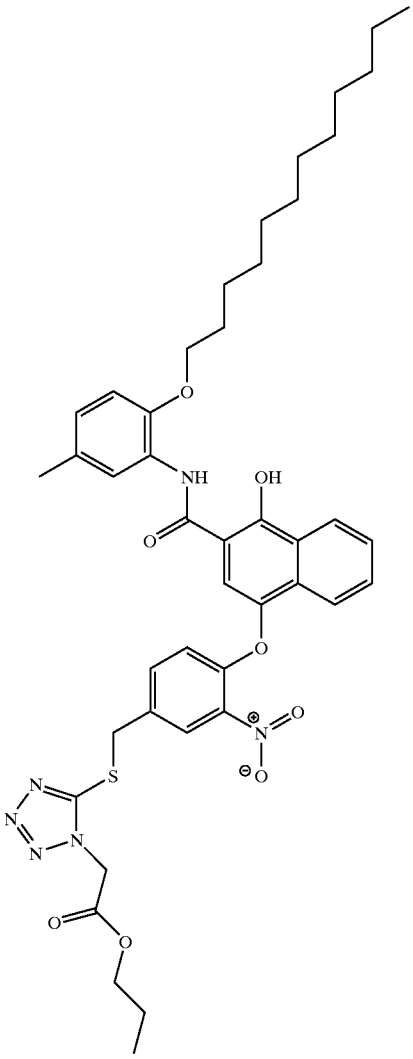
(C-XII)
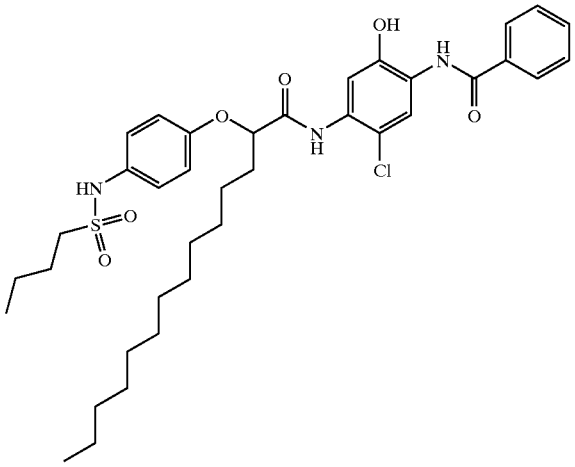
-continued
(C-XIII)
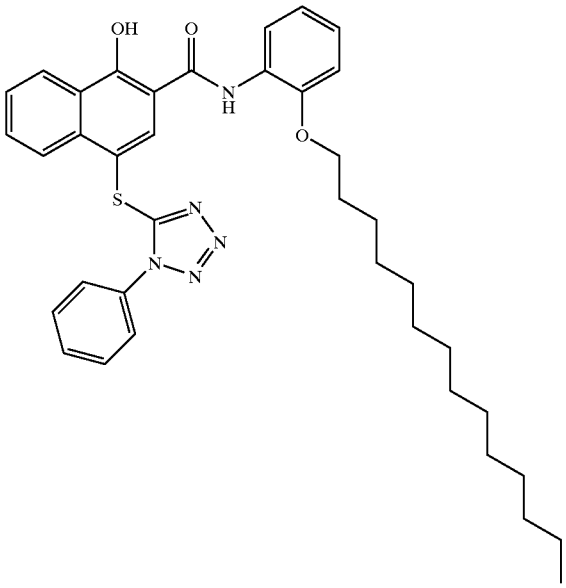
(C-XIV)
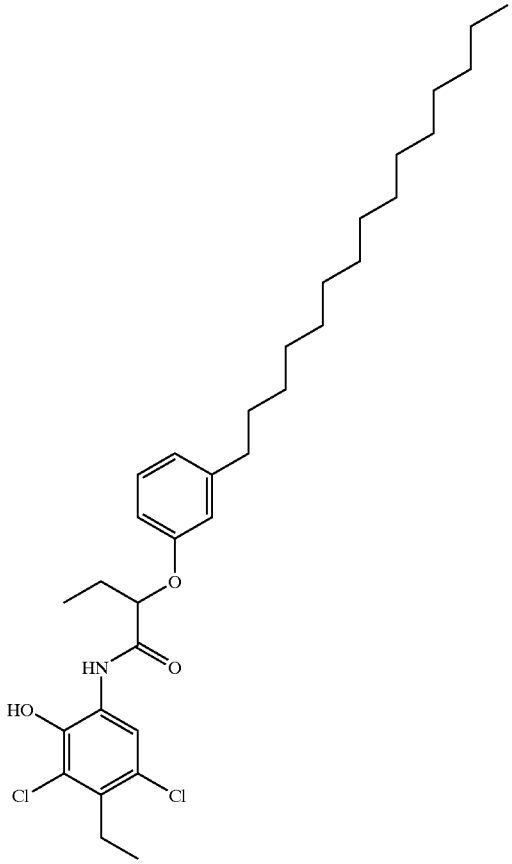

-continued (C-XV)

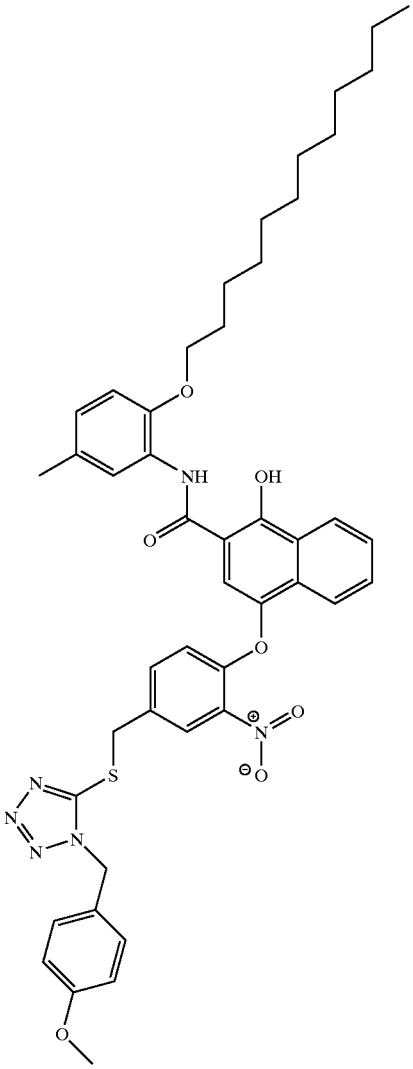

The multifunctional dye-forming couplers useful in the invention can be incorporated in the imaging element in any manner known in the art. These methods include, but are not limited to, incorporation as oil-in-water emulsions, known colloquially in the photographic arts as "dispersions", as reverse phase emulsion, as solid particle dispersions, as multiphase dispersions, as molecular dispersions or "Fisher" dispersions, or as polymer loaded dispersions or loaded latex dispersions. When the multifunctional dye forming couplers are polymeric in nature, they can additionally be incorporated merely by physically diluting the polymeric coupler with vehicle. While the multifunctional dye forming coupler can be employed in the element at any concentration that enables the desired formation of an image, it is preferred that the multifunctional dye forming coupler be applied to the element at between about 50 and 3000 mg/M$^2$. It is more preferred that the multifunctional dye forming coupler be applied to the element at between about 200 and 800 mg/m$^2$.

The imaging element can further comprise an incorporated solvent. In one embodiment, the multifunctional dye forming coupler is provided as an emulsion in such a solvent. In this embodiment, any of the high boiling organic solvents known in the photographic arts as "coupler solvents" can be employed. In this situation, the solvent acts as a manufacturing aid. Alternatively, the solvent can be incorporated separately. In both situations, the solvent can further function as a coupler stabilizer, a dye stabilizer, a reactivity enhancer or moderator, or as a hue shifting agent, all as known in the photographic arts. Additionally, auxiliary solvents can be employed to aid dissolution of the multifunctional dye forming coupler in the coupler solvent. Particulars of coupler solvents and their use are described in the aforesaid mentioned references and in *Research Disclosure*, Item 37038 (1995), Section IX, Solvents, and Section XI, Surfactants, incorporated herein by reference. Specific examples of some coupler solvents include, but are not limited to, tritoluyl phosphate, dibutyl phthalate, N,N-diethyldodecanamide, N,N-dibutyldodecanamide, tris(2-ethylhexyl)phosphate, acetyl tributyl citrate, 2,4-di-tert-pentylphenol, 2-(2-butoxyethoxy)ethyl acetate and 1,4-cyclohexyldimethylene bis(2-ethylhexanoate). The choice of coupler solvent and vehicle can influence the hue of dyes formed, as disclosed by Merkel et al at U.S. Pat. Nos. 4,808,502 and 4,973,535. Generally, it is found that materials with a hydrogen-bond-donating ability can shift dyes bathochromically, while materials with a hydrogen-bond-accepting ability can shift dyes hypsochromically. Additionally, use of materials with low polarizability can of itself promote hypsochromic dye hue shifts as well as promote dye aggregation. It is recognized that coupler ballasts often enable dyes and dye-coupler mixtures to function as self-solvents with a concomitant shift in hue. The polarizability, and the hydrogen-bond-donating and accepting ability of various materials are described by Kamlet et al in *J. Org. Chem*, 48, 2877–87 (1983), the disclosures of which are incorporated by reference.

Generally one or more developer precursors are employed in the practice of this invention and are incorporated in the imaging element during manufacture. The term "developer precursor" includes "blocked developer" and other compounds that convert or otherwise react to form a developing agent. The developer precursors are preferably supplied in a blocked form as described below and elsewhere. These developer precursors can release any developers known in the art that are coupling developers and enable the formation of distinctly colored dyes from the same coupler. By "distinctly colored" is meant that the dyes formed differ in the wavelength of maximum adsorption by at least 50 nm. It is preferred that these dyes differ in the maximum adsorption wavelength by at least 65 nm and more preferred that they differ in the maximum adsorption wavelength by at least 80 nm.

Typically, a cyan dye is a dye having a maximum absorption at between 580 and 710 nm, with preferably a maximum absorption between 590 and 680 nm, more preferably a peak absorption between 600 and 670 nm. Typically, a magenta dye is a dye having a maximum absorption at between 500 and 580 nm, with preferably a maximum absorption between 515 and 565 nm, more preferably a peak absorption between 520 and 560 nm and most preferably a peak absorption between 525 and 555 nm. Typically, a yellow dye is a dye having a maximum absorption at between 400 and 500 nm, with preferably a maximum absorption between 410 and 480 nm, more preferably a peak absorption between 435 and 465 nm and most preferably a peak absorption between 445 and 455 nm. Typically an infrared dye is a dye having peak absorption between about 710 and 1000 nm. A near infrared dye has a peak absorption between about 710 and 790 nm while a far infrared dye has a peak absorption between about 790 and 1000 nm. The concentrations and amounts of the distinct developers and the multifunctional dye forming coupler will typically be chosen so as to enable the formation of dyes having a density at maximum absorption of at least 0.7, preferably a density of at least 1.0, more preferably a density of at least 1.3 and most preferably a density of at least 1.6. For cyan, magenta or yellow dyes, these will be densities measured in a photographic element using status M filters. Further, the dyes will typically have a half height band width (HHBW) of between 70 and 170 nm. Preferably, the HHBW will be less than 150 nm, more preferably less than 130 nm and most preferably less than 115 nm.

Thus, a multifunctional dye forming coupler according to the present invention results in a cyan dye being formed when reacted with the oxidized form of a developer in its salt or neutral form of Structure II:

$$A—(CR^1{=}{=}CR^2)_n—NHY \quad (II)$$

In structure II, n is 2 such that $(CR^1{=}{=}CR^2)_2$ represents a phenylene ring that can be further substituted or unsubstituted, wherein:

A is OH, or $NR^3R^4$;

Y is H, or a group that cleaves before or during a coupling reaction to form YH; and $R^1$ $R^2$, $R^3$ and $R^4$, which can be the same or different are individually H, alkyl, substituted alkyl, alkenyl, substituted alkenyl, aryl, substituted aryl, halogen, cyano, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl or wherein at least two of $R^1$ $R^2$, $R^3$ and $R^4$ together can further form a substituted or unsubstituted carbocyclic or heterocyclic ring structure. (The two $R^1$ substituents and two $R^2$ substituents can differ.)

Specific examples of cyan dye-forming developers include but are not limited to the oxidized form of a color developer chosen from the group consisting of N,N-diethyl-p-phenylenediamine, 4-N,N-diethyl-2-methylphenylenediamine, 4-(N-ethyl-N-2-methanesulfonylaminoethyl)-2-methylphenylenediamine, 4-(N-ethyl-N-2-hydroxyethyl)-2-methylphenylenediamine, 4-N,N-diethyl-2-methanesulfonylaminoethylphenylenediamine, 4-(N-ethyl-N-2-methoxyethyl)-2-methylphenylenediamine, 4,5-dicyano-2-isopropylsulfonylhydrazinobenzene and 4-amino-2,6-dichlorophenol. Preferred cyan dye-forming developers can also be physically characterized as having an $E_{1/2}$ at pH 11 more positive than 190 mV. The sign convention and method of measuring the oxidation-reduction potential or E ½ of a developer is that described in *The Theory of the Photographic Process*, 4th ed., T. H. James, ed., Macmillan, New York 1977 at pages 291 through 403, the disclosures of which are incorporated by reference. This reference is additionally cited for its disclosure of specific developers useful in the practice of this invention. Other useful developers and developer precursors are disclosed by Hunig et al, *Angew. Chem.*, 70, page 215-ff (1958), by Schmidt et al, U.S. Pat. No. 2,424,256, Pelz et al, U.S. Pat. No. 2,895,825, Wahl et al, U.S. Pat. No. 2,892,714, Clarke et al, U.S. Pat. Nos. 5,284,739 and 5,415,981, Takeuchi et al, U. S. Pat. No. 5,667,945, and Nabeta U.S. Pat. No. 5.723, 277, the disclosures of which are all incorporated by reference.

A useful imaging member comprises a multifunctional dye forming coupler that results in an infrared dye being formed when reacted with the oxidized form of a developer in its salt or neutral form of Structure III:

$$A—(CR^1{=}{=}CR^2)_n—NHY \quad (III)$$

wherein n is 2 such that $(CR^1{=}{=}CR^2)_2$ represents a phenylene ring that can be further substituted or unsubstituted, wherein A, Y, $R^1$ and $R^2$ are as defined above. It is noted that the developer of Structure III will differ from the developer of Structure II. In one embodiment, the dyes formed from the MFC coupler using the developer of structure II (to obtain a cyan dye) will have a major peak absorbance differing from the dye formed from the same MFC coupler with the developer of structure III (to form an infrared dye) by a difference is at least 50 nm, more preferably 80 nm, and most preferably by 100 nm or even more.

Some specific examples of such infrared forming developers include, but are not limited to, the oxidized form of a color developer chosen from the group consisting of 4-N, N-diethyl-2-methyl-6-methoxyphenylenediamine, 4-N,N-diethyl-2,6-dimethylphenylenediamine, 4-(N-ethyl-N-2-methanesulfonylaminoethyl)-2,6-dimethylphenylenediamine, 4-(N-ethyl-N-2-hydroxyethyl)-2,6-dimethylphenylenediamine, 4-N,N-diethyl-2-methanesulfonylaminoethyl-6-methylphenylenediamine, 4-(N-ethyl-N-2-hydroxyethyl)-2-ethoxyphenylenediamine, and 4-(N-ethyl-N-2-methoxyethyl)-2,6-dimethylphenylenediamine. Preferred infrared dye forming developers can also be characterized in having an E ½ at pH 11 less positive than 200 mV.

In one preferred embodiment, in Structures II and III, the partial structure $—(CR^1{=}{=}CR^2)_n—$ represents a substituted or unsubstituted phenylene moiety. When $—(CR^1{=}{=}CR^2)_n—$ represents an aromatic moiety, the moieties —A and —NHY are preferably in a para relationship, one to another.

In Structures II and III, when Y is a group that cleaves before or during a coupling reaction to form YH, then Y is preferably the moiety $Q—R^6$ wherein:

$R^6$ is H, alkyl, substituted alkyl, alkenyl, substituted alkenyl, alkynyl, substituted alkynyl, aryl, substituted aryl, heterocyclic or substituted heterocyclic, and Q is $—SO_2—$, —SO—, $—SO_3—$, —CO—, —COCO—, —CO—O—, —CO(NR7)—, —COCO—O, —OCO—N($R^7$)— or $—SO_2—N(R^7)—$, where $R^7$ is H or the groups described in $R^6$.

In Structures II and III, the word "substituted" at each occurrence represents any group other than H needed to satisfy the required valence which does not adversely affect the required properties. The word "substituted" preferably represents one or more of a linear or branched carbonaceous group which can be cyclic or acyclic, a heterocyclic group, an aromatic carbonaceous group, an arylalkyl group, a halogen atom, a cyano group, a nitro group, a ureido group, an ether group, an ester group, an amine group, an amide group, a thioether group, a thioester group, a sulfonyl group or a sulfamyl group.

A multifunctional coupler that forms a near infrared dye on reaction with an oxidized form of developer II can form a far infrared dye on reaction with an oxidized form of developer III.

It is possible to provide hue shifting developing agents in the other imaging layers, for example, to produce a cyan color from a magenta dye. See for example, commonly assigned, co-pending Ser. No. 09/930,939 and Ser. No. 09/871,310 and Ser. No. 09/871,522, all of which are hereby incorporated by reference in their entirety. It may be desirable to combine the above-described IR dye-forming system, in a photothermographic element, with hypso shifted cyan and magenta couplers. Typically, the infrared dye is sufficiently broad that there is some overlap with the cyan and magenta dye peaks formed from conventional cyan and magenta couplers. Improved separation between the infrared-dye forming channel and the cyan- and magenta-dye forming channels can be achieved by using hypsochromically shifted cyan—and magenta couplers. It may be desirable, therefore, to employ a coupler with a lambda max between 550 and 650 in the red channel, and a coupler with a lambda max between 450 and 550 in the green channel.

A typical color negative film construction useful in the practice of the invention is illustrated by the following element, SCN-1:

| Element SCN-I | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

Details of support construction are well understood in the art. Examples of useful supports are poly(vinylacetal) film, polystyrene film, poly(ethyleneterephthalate) film, poly (ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure*, September 1996, Number 389, Item 38957 (hereafter referred to as ("*Research Disclosure I*").

The photographic elements of the invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Each of blue, green and red recording layer units BU, GU and RU are formed of one or more hydrophilic colloid layers and contain at least one radiation-sensitive silver halide emulsion. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. In this case, the coupler containing layer is usually the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m. In another embodiment, sensitized layers disposed on two sides of a support, as in a duplitized film, can be employed.

In a preferred embodiment of this invention, the processed photographic film contains only limited amounts of color masking couplers, incorporated permanent Dmin adjusting dyes and incorporated permanent antihalation dyes. Generally, such films contain color masking couplers in total amounts up to about 0.6 mmol/m$^2$, preferably in amounts up to about 0.2 mmol/m$^2$, more preferably in amounts up to about 0.05 mmol/m$^2$, and most preferably in amounts up to about 0.01 mmol/m$^2$. The complete omission of masking couplers is particularly contemplated.

The incorporated permanent Dmin adjusting dyes are generally present in total amounts up to about 0.2 mmol/m$^2$, preferably in amounts up to about 0.1 mmol/m$^2$, more preferably in amounts up to about 0.02 mmol/m$^2$, and most preferably in amounts up to about 0.005 mmol/m$^2$. The complete omission of Dmin adjusting dyes is particularly contemplated.

The incorporated permanent antihalation density is up to about 0.6 in blue, green or red density, more preferably up to about 0.3 in blue, green or red density, even more preferably up to about 0.1 in blue, green or red density and most preferably up to about 0.05 in blue, green or red Status M density. The complete omission of permanent antihalation density is particularly contemplated.

Limiting the amount of color masking couplers, permanent antihalation density and incorporated permanent Dmin adjusting dyes serves to reduce the optical density of the films, after processing, and thus improves the subsequent scanning and digitization of the imagewise exposed and processed films.

Overall, the limited Dmin and tone scale density enabled by controlling the quantity of incorporated color masking couplers, incorporated permanent Dmin adjusting dyes and antihalation and support optical density can serve to both limit scanning noise (which increases at high optical densities), and to improve the overall signal-to-noise characteristics of the film to be scanned. Relying on the digital correction step to provide color correction obviates the need for color masking couplers in the films.

Any convenient selection from among conventional radiation-sensitive silver halide emulsions can be incorporated within the layer units and used to provide the spectral absorptances of the elements of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. However, in a preferred embodiment, a preponderance low reflectivity grains are preferred. By preponderance is meant that greater than 50% of the grain projected area is provided by low reflectivity silver halide grains. It is even more preferred that greater than 70% of the grain projected area be provided by low reflectivity silver halide grains. Low reflective silver halide grains are those having an average grain having a grain thickness >0.06, preferably >0.08, and more preferable >0.10 microns. The grains preferably form surface latent images so that they produce negative images when processed in a surface developer in color negative film forms of the invention.

Illustrations of conventional radiation-sensitive silver halide emulsions are provided by *Research Disclosure I*, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The elements of this invention comprise layer units individually comprising silver halides that are spectrally sensitized so as to record portions of the visible light spectrum, typically as red, green or blue light. The spectral sensitizations are intended to mimic the spectral response of the human visual system and allow accurate scene recording of humanly interesting scenes. Here, a blue light sensitive layer unit is one having spectral sensitivity to light in the 400 to 500 nm range and preferably having a peak sensitivity in the 440 to 480 nm range. A green light sensitive layer unit is one having spectral sensitivity to light in the 500 to 600 nm range and preferably having a peak sensitivity in the 520 to 570 nm range. A red light sensitive layer unit is one having spectral sensitivity to light in the 600 to 700 nm range and preferably having a peak sensitivity in the 610 to 670 nm range. According to the invention a multifunctional coupler can be incorporated in one of these layers. Additional auxiliary imaging layers having blue-green sensitivity or green-red sensitivity can be present in the elements of the invention. These layers can additionally comprise a multifunctional coupler. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure I*, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation, one or more dopants (grain occlusions other than silver and halide) can be introduced to modify grain properties. For example, any of the various conventional dopants disclosed in *Research Disclosure I*, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm, et al., U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure, I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be not more than 4.5 g/m$^2$ of silver, preferably less. Silver quantities of less than 4.0 g/m$^2$ are preferred, and silver quantities of less than 3.5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.0 g of coated silver per m$^2$ of support surface area in the element is necessary to realize an exposure latitude of at least 2.7 log E while maintaining an adequately low graininess position for pictures intended to be enlarged. Silver coverages in excess of 1.5 g/m$^2$ are preferred while silver coverages in excess of 2.5 g/m$^2$ are more preferred.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on peak shielding and broadening of the underlying layer spectral sensitivity.

The inter-layers IL1 and IL2 are hydrophilic colloid layers having as their primary function color contamination reduction-i.e., prevention of oxidized developing agent from migrating to an adjacent recording layer unit before reacting with dye-forming coupler. The inter-layers are in part effective simply by increasing the diffusion path length that oxidized developing agent must travel. To increase the effectiveness of the inter-layers to intercept oxidized developing agent, it is conventional practice to incorporate oxidized developing agent. Antistain agents (oxidized developing agent scavengers) can be selected from among those disclosed by *Research Disclosure I*, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure I*, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure I*, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit.

Most typically the SOC contains addenda, such as coating aids, plasticizers and lubricants, antistats and matting agents, such as illustrated by *Research Disclosure I*, Section IX. Coating physical property modifying addenda. The SOC overlying the emulsion layers additionally preferably contains an ultraviolet absorber, such as illustrated by *Research Disclosure I*, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density-i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. What is desirable is that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 nm (preferably 50 nm) spectral region that is not occupied by an absorption half-peak band width of another image dye. Ideally the image dyes exhibit absorption half-peak bandwidths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.6 are contemplated and exposure latitudes of up to about 5.0 log E or higher are feasible. Gammas above 0.25 are preferred and gammas above 0.30 are more preferred. Gammas of between about 0.4 and 0.5 are especially preferred.

In a preferred embodiment the dye image is formed by the use of an incorporated developing agent, in reactive association with each color layer. More preferably, the incorporated developing agent is a blocked developing agent.

Examples of blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P0.10 7DQ, ENGLAND; U.S. Pat. No. 4,157,915, to Hamaoka et al.; U.S. Pat. No. 4,060,418, to Waxman and Mourning; and in U.S. Pat. No. 5,019,492. Other examples of blocked developers that can be used in photographic elements of the present invention include, but are not limited to, the blocked developing agents described in U.S. Pat. No. 3,342,599, to Reeves; Research Disclosure (129 (1975) pp. 27–30) published by Kenneth Mason Publications, Ltd., Dudley Annex, 12a North Street, Emsworth, Hampshire P0.10 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30,1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR PHOTOTHERMOGRAPHIC ELEMENT CONTAINING A BLOCKED PHOTOGRAPHICALLY USEFUL COMPOUND. In one embodiment of the invention, the blocked developer may be respresented by the following Structure I:

$$\text{DEV—(LINK 1)}_l\text{—(TIME)}_m\text{—(LINK 2)}_n\text{—}B \qquad \text{I}$$

wherein,

DEV is a silver-halide color developing agent;

LINK 1 and LINK 2 are linking groups;

TIME is a timing group;

1 is 0 or 1;

m is 0, 1, or 2;

n is 0 or 1;

1+n is 1 or 2;

B is a blocking group or B is:

$$\text{—B'—(LINK 2)}_n\text{—(TIME)}_m\text{—(LINK 1)}_l\text{—DEV}$$

wherein B' also blocks a second developing agent DEV.

In a preferred embodiment of the invention, LINK 1 or LINK 2 are of structure II:

II

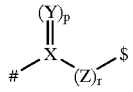

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

A number of modifications of color negative elements have been suggested for accommodating scanning, as illustrated by *Research Disclosure I*, Section XIV, Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image that, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The imaging element of the invention may also be a black and white image-forming material comprised, for example, of a pan-sensitized silver halide emulsion and a developer of the invention. In this embodiment, the image may be formed by developed silver density following processing, or by a coupler that generates a dye which can be used to carry the neutral image tone scale.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by re-conversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. In a like vein, it is preferred that the gamma ratios be greater than 0.8, more preferred that they be greater than 0.85 and most preferred that they be greater than 0.9. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or de-amplifying the gamma vs. log E (exposure) curve to a value of 0.65 before determining the speed in the otherwise defined manner.

The present invention also contemplates the use of photographic (including photothermographic) elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in Stoebe, et al., U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure I*, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following process steps: image scanning to produce an electronic rendition of the capture image, and subsequent digital processing of that rendition to manipulate, store, transmit, output, or display electronically that image.

As mentioned above, the photographic elements of the present invention can be photothermographic elements, for example of the type described in *Research Disclosure*, June 1978, Item No. 17029 (hereafter "Research Disclosure I") are included by reference, and as also described in more recent patents in the photothermographic field. The photothermographic elements may be of the type A or type B disclosed in *Research Disclosure I*. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

A photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

The photothermographic element can comprise a thermal solvent. Examples of useful thermal solvents. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

Photothermographic elements as described can contain addenda that are known to aid in formation of a useful image. The photothermographic element can contain development modifiers that function as speed increasing compounds, sensitizing dyes, hardeners, anti-static agents, plasticizers and lubricants, coating aids, brighteners, absorbing and filter dyes, such as described in *Research Disclosure*, December 1978, Item No. 17643 and *Research Disclosure*, June 1978, Item No. 17029.

After imagewise exposure of a photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed by Stoebe, et al., U.S. Pat No. 6,062,746 and Szajewski, et al., U.S. Pat. No. 6,048,110, commonly assigned, which are incorporated herein by reference. The use of an apparatus whereby the processor can be used to write information onto the element, information which can be used to adjust processing, scanning, and image display is also envisaged. This system is disclosed in now allowed Stoebe, et al., U.S. patent application Ser. No. 09/206,914 filed Dec. 7, 1998 and U.S. patent application Ser. No. 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443.

Algorithms to reduce image noise and improve sharpness in the red, green, and blue channels of scanned images are well known in the art. However, if an infrared coupler is used to carry visible scene information in a photothermographic film, the accompanying scan may have additional noise or sharpness loss due to the CCD capture characteristics at long wavelengths. Image-processing algorithms specifically designed for an infrared channel may be required. Furthermore, it may be advantageous to match scanner diodes to the IR dye absorption peak. The diodes used in area array scanners are typically matched to the dyes used in the media to be scanned. The use of an IR dye in a photothermographic film will require the presence of IR diodes, preferably matched to the absorption characteristics of the dye. In one embodiment, a photothermographic film element containing an infrared coupler and developer according to the present invention, in the same layer, is exposed, processed, and then scanned with an area array CCD scanner illuminated with a diode having a wavelength between 720 and 800 nm.

It may also be advantageous for the IR dye-forming layer to be furthest from scanner during scanning operation. An infrared dye-forming layer will experience the least amount of scattering during a scanning operation. Therefore, it would be preferable to locate the IR dye-containing layer furthest from the scanner element during the scanning operation. In one embodiment, an IR dye-forming layer containing an infrared dye forming coupler and developer according to the present invention is coated in association with a blue-sensitized emulsion in the top-most imaging layer of a multilayer film. Following processing, the film is oriented during scanning so that it is illuminated from the top (emulsion-side), with the capture element located on the support side of the coating. In a second embodiment, the infrared dye-forming layer comprises an infrared dye forming coupler and developer in association with a red-sensitized silver halide emulsion in the bottom-most imaging layer of a color negative film. Following processing, the film is oriented during scanning so that it is illuminated from the bottom (support-side), with the capture element located on the emulsion (top) side of the coating.

The use of an infrared dye-forming coupler to record visible (R, G, or B) scene information in a photothermographic film can lead to decreased light scattering and improvements in film scanning properties. However, current color algorithms use conventional color mapping (B→B. G→G, R→R) techniques to reproduce scene colors. An IR imaging layer, therefore, would require a modified algorithm (such as, G→B, R→G, and IR→R), as will be understood by the skilled artisan. Thus, it may be desirable, when a photothermographic film element comprising at least one light-sensitive layer containing the infrared dye forming coupler according to the present invention is exposed, processed, and scanned with R, G, IR, for an image processing algorithm then remaps the R, G, and IR densities to the appropriate R, G, B color space.

Nevertheless, the retained silver halide can scatter light, decrease sharpness and raise the overall density of the film thus leading to impaired scanning. Further, retained silver halide can printout to ambient/viewing/scanning light, render non-imagewise density, degrade signal-to noise of the original scene, and raise density even higher. Finally, the retained silver halide and organic silver salt can remain in reactive association with the other film chemistry, making the film unsuitable as an archival media. Removal or stabilization of these silver sources are necessary to render the PTG film to an archival state.

Furthermore, the silver coated in the PTG film (silver halide, silver donor, and metallic silver) is unnecessary to the dye image produced, and this silver is valuable and the desire is to recover it is high.

Thus, it may be desirable to remove, in subsequent processing steps, one or more of the silver containing components of the film: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical as known in the photographic arts. Specific examples of useful chemicals include: thioethers, thioureas, thiols, thiones, thionamides, amines, quaternary amine salts, ureas, thiosulfates, thiocyanates, bisulfites, amine oxides, iminodiethanol -sulfur dioxide addition complexex, amphoteric amines, bis-sulfonylmethanes, and the carbocyclic and heterocyclic derivatives of these compounds. These chemicals have the ability to form a soluble complex with silver ion and transport the silver out of the film into a receiving vehicle. The receiving vehicle can be another coated layer (laminate) or a conventional liquid processing bath.

The stabilization of the silver halide and silver donor can also be accomplished with a common stabilization chemical. The previously mentioned silver salt removal compounds can be employed in this regard. With stabilization, the silver is not necessarily removed from the film, although the fixing agent and stabilization agents could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning.

The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the PTG film. Therefore, if stabilization of the PTG film is favored over removal of silver, the bleach step can be skipped and the metallic silver left in the film. In cases where the metallic silver is removed, the bleach and fix steps can be done together (called a blix) or sequentially (bleach+fix).

The process could involve one or more of the scenarios or permutations of steps. The steps can be done one right after another or can be delayed with respect to time and location. For instance, heat development and scanning can be done in a remote kiosk, then bleaching and fixing accomplished several days later at a retail photofinishing lab. In one embodiment, multiple scanning of images is accomplished. For example, an initial scan may be done for soft display or a lower cost hard display of the image after heat processing, then a higher quality or a higher cost secondary scan after stabilization is accomplished for archiving and printing, optionally based on a selection from the initial display.

For illustrative purposes, a non-exhaustive list of photothermographic film processes involving a common dry heat development step are as follows:

1. heat development→scan→stabilize (for example, with a laminate)→scan→obtain returnable archival film.
2. heat development→fix bath→water wash→dry→scan→obtain returnable archival film
3. heat development→scan→blix bath→dry→scan→recycle all or part of the silver in film
4. heat development→bleach laminate→fix laminate→scan→(recycle all or part of the silver in film)
5. heat development→scan→blix bath→wash→fix bath→wash→dry→obtain returnable archival film
6. heat development→relatively rapid, low quality scan
7. heat development→bleach→wash→fix→wash→dry→ relatively slow, high quality scan Photothermographic or photographic elements of the present invention can also be subjected to low volume processing ("substantially dry" or "apparently dry") which is defined as photographic processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

An apparently dry photothermographic element or photographic element may receive some or all of the following three treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

Heating of a photothermographic element during processing may be effected by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C. or above.

Once developed dye image records (or the like) have been formed in the processed photographic elements of the invention, conventional techniques can be employed for retrieving the image information for each color record and manipulating the record for subsequent creation of a color balanced viewable image. For example, it is possible to scan the photographic element successively within the appropriate regions of the spectrum or to incorporate appropriate light within a single scanning beam that is divided and passed through corresponding filters to form separate scanning beams for each color record. A simple technique is to scan the photothermographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng et al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256, Kaplan U.S. Pat. No. 4,977,521, Sakai U.S. Pat. No. 4,979,027; Ng U.S. Pat. No. 5,003,494; Katayama et al U.S. Pat. No. 5,008,950, Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference.

Further illustrations of the capability of those skilled in the art to manage color digital image information are provided by Giorgianni and Madden *Digital Color Management*, Addison-Wesley, 1998.

EXAMPLE

A multilayer, multicolor light sensitive Element A was prepared having a support bearing a red light sensitive silver halide layer unit having Coupler 1, a green light sensitive silver halide layer unit having Coupler 2, and a blue light sensitive silver halide layer unit having Coupler 3. Element A contained subbing layers, overcoat layers and other components as known in the art. Element B was like element A except Coupler 2 was replaced by Coupler 4 in the green light sensitive layer unit and Coupler 3 was replaced by Coupler 2 in the blue light sensitive layer unit. Element C was like Element B except that Coupler 1 was replaced by Coupler 4 in the red light sensitive layer unit and Coupler 4 was replaced by Coupler 1 in the green light sensitive layer unit. The three elements were slit and perforated to 135 film format, loaded into cartridges and exposed to test scenes using a camera. After development using developer D-1, Element A exhibited yellow, magenta and cyan colored images, Elements B and C each exhibited magenta, cyan and infrared colored images. The elements were not de-silvered by bleaching or fixing. Below are the structures of the above-mentioned compounds:

Coupler 1

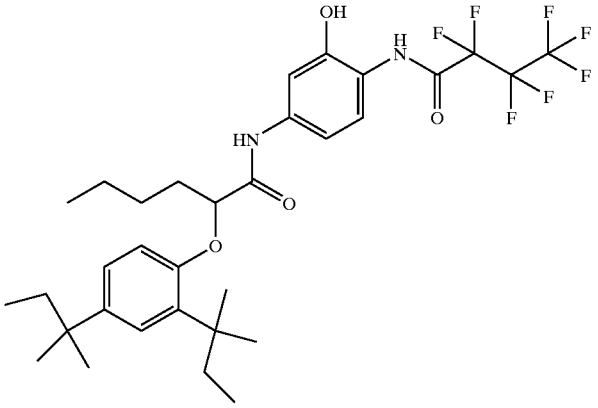

Coupler 2

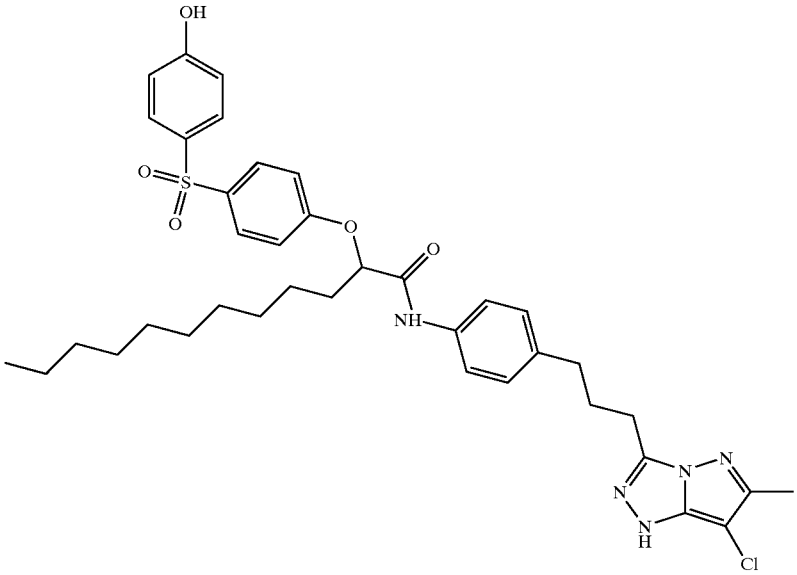

-continued
Coupler 3
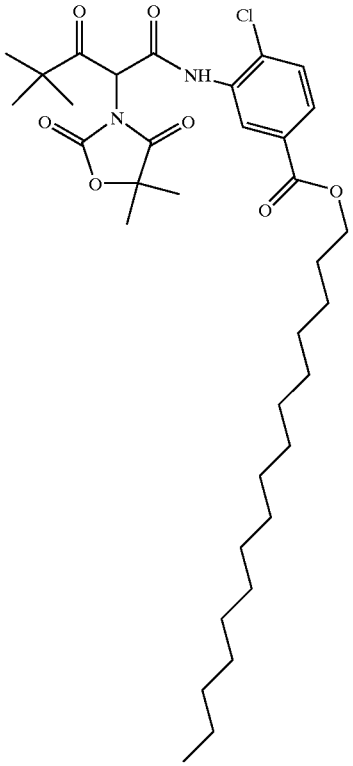
Coupler 4
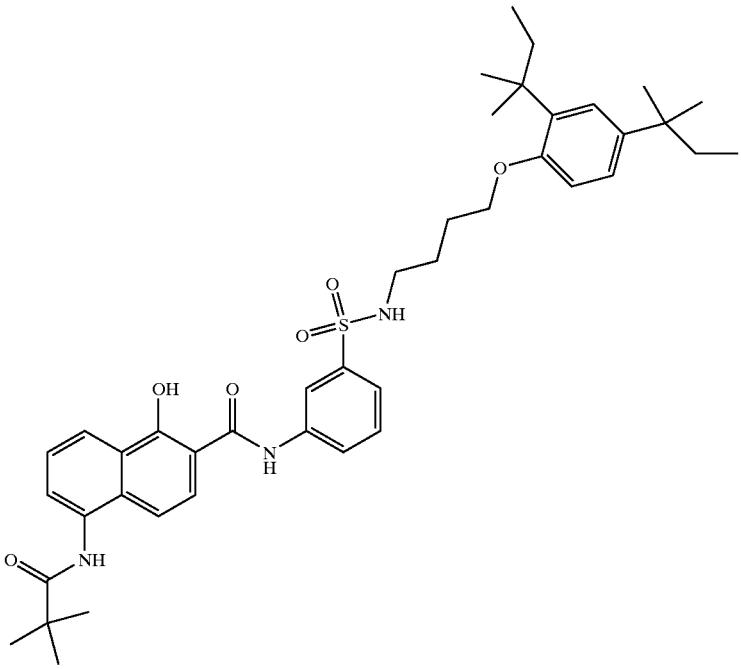
D-1
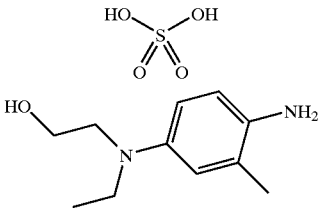

-continued

D-2

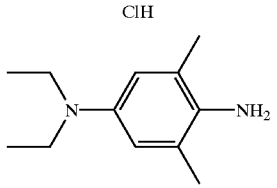

Table 1 below shows the percent transmission of elements in selected wavelength ranges after development. Table 2 below shows the hue of images in elements A, B and C after development.

TABLE 1

| % T at 450 nm | % T at 550 nm | % T at 650 nm | % T at 750 nm | % T at 850 nm |
|---|---|---|---|---|
| 12% | 18% | 28% | 34% | 38% |

As is apparent from this data, the developed but not desilvered color elements show poor light transmission in the blue region with ever improving light transmission in the green, red and infrared regions.

TABLE 2

| Element | Hue of red layer image | Hue of green layer image | Hue of Blue layer image |
|---|---|---|---|
| A | 664.3 nm | 551.5 nm | 449.0 nm |
| B | 664.3 nm | 753.9 nm | 551.5 nm |
| C | 753.9 nm | 664.3 nm | 551.5 nm |

The MTF percent responses were determined by applying a sinusoidal white light exposure pattern to an element and developing that element without subsequent desilvering. Under these conditions, The MTF percent response to 450 nm (blue) light was 80% while to 750 nm light (IR) was 105%, thus confirming the improved specularity of light transmission through the element when it was scanned in the infrared region and the improved sharpness of an image formed under these conditions and then scanned in the infrared region.

As is readily apparent, matching the hues of the formed dyes to wavelengths of light where silver halides are more transmissive results in the formation of images that are more readily scanned.

The images formed in elements A, B and C were scanned to blue, green, red or IR light as appropriate for the dye records formed, digitized, and the images were digitally reconstructed to the proper color relationships and formed to prints. The prints from Elements B and C were colorful and showed an improved image relative to that obtained from Element A, thus confirming the advantages of the invention.

In a separate experiment, a sample of Kodak Gold 800 υ color negative film, (formulated like Element A) was developed using developer D-2. Shifted color records were formed having absorption maxima at 471.9 nm, 615.1 nm and 719.4 nm.

In a separate experiment, element Element C can be developed using developer D-2. Shifted color records are formed having absorption maxima at 615.1 nm, 719.4nm and at >800 nm.

Elements can be prepared using appropriately blocked versions of D-1 and D-2 along with melt formers and incorporated silver salts to prepare photothermographic elements that form shifted color records suitable for scanning after imagewise exposure and heating. Examples of photothermographic elements that can be modified according to the present invention are disclosed in commonly assigned U.S. Ser. No. 60/211,061, hereby incorporated by reference in its entirety.

In another embodiment, blocked variants of D-1 and D-2 can be delivered to the light sensitive elements from laminates to enable formation of shifted color records suitable for scanning.

The invention has been described in detail with particular reference to certain preferred embodiments thereof, but it will be understood that variations and modifications can be effected within the spirit and scope of the invention.

What is claimed is:

1. A light sensitive color photographic imaging element comprising a red-light-sensitive silver halide emulsion layer unit, a green-light-sensitive silver halide emulsion layer unit, and a blue-light-sensitive silver halide emulsion layer unit, wherein at least one light-sensitive layer unit has, in reactive association, a multifunctional coupler and a developer precursor liberating a developing agent enabling formation of an infrared dye from the multifunctional coupler on development, wherein the multifunctional coupler has the property that it is capable of forming a distinctly colored cyan dye with an oxidized form of the developer 4-(N-ethyl-N-2-hydroxyethyl)-2-methylphenylenediamine.

2. The element of claim 1 wherein the developer precursor liberates a developer according to the following structure:

$$A—(CR^1{=}{=}CR^2)_2—NHY$$

wherein:

A is OH, or $NR^3R^4$;

Y is H, or a group that cleaves before or during a coupling reaction to form YH; and $R^1$, $R^2$, $R^3$, and $R^4$, which can be the same or different, are individually H, alkyl, substituted alkyl, alkenyl, substituted alkenyl, aryl, substituted aryl, halogen, cyano, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl, or wherein at least two of $R^1$, $R^2$, $R^3$ and $R^4$ together further form a substituted or unsubstituted carbocyclic or heterocyclic ring structure.

3. The element of claim 1 wherein the developer precursor liberates an aminophenol developing agent.

4. A light sensitive color photographic imaging element comprising a red-light-sensitive silver halide emulsion layer unit, a green-light-sensitive silver halide emulsion layer unit, and a blue-light-sensitive silver halide emulsion layer unit, wherein at least one light-sensitive layer unit has at least two different couplers including, in reactive association, a multifunctional coupler and a developer precursor liberating a developing agent enabling formation of an infrared dye from the multifunctional coupler on development, wherein the multifunctional coupler has the property that it is capable of forming at least one other distinctly colored dye with a oxidized form of a second different developing agent, wherein both developing agents are selected from the class of developing agents represented by the following structure:

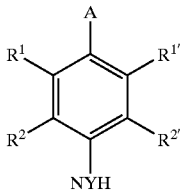

wherein:

A is OH, or $NR^3R^4$;

Y is H, or a group that cleaves before or during a coupling reaction to form YH; and $R^1$, $R^2$, $R^3$ and $R_4$, which can be the same or different, are individually H, alkyl, substituted alkyl, alkenyl, substituted alkenyl, aryl, substituted aryl, halogen, cyano, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl or wherein at least two of $R^1$, $R^2$, $R^3$ and $R^4$ together form a substituted or unsubstituted carbocyclic or heterocyclic ring structure.

5. The element of claim 2 wherein the developing agent is selected from the group consisting of 4-N,N-diethyl-2-methyl-6-methoxyphenylenediamine, 4-N,N-diethyl-2,6-dimethylphenylenediamine, 4-(N-ethyl-N-2-methanesulfonylaminoethyl)-2,6-dimethylphenylenediamine, 4-(N-ethyl-N-2-hydroxyethyl)-2,6-dimethylphenylenediamine, 4-N,N-diethyl-2-methanesulfonylaminoethyl-6-methylphenylenediamine, 4-(N-ethyl-N-2-hydroxyethyl)-2-ethoxyphenylenediamine, and 4-(N-ethyl-N-2-methoxyethyl)-2,6-dimethylphenylenediamine.

6. The element of claim 2 wherein the developing agent has an $E_{1/2}$ at pH 11 less positive than 200 mV.

7. The light sensitive element of claim 1, wherein the multifunctional coupler has the following structure:

(I)

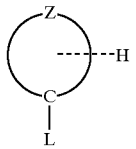

wherein:

C is a carbon atom at which coupling occurs;

L represents a hydrogen atom or a leaving group covalently bound to C and which is displaced on coupling;

H is an acidic hydrogen atom serving to direct coupling to C and which is covalently bound to C directly or by conjugation; and Z represents the remainder of the atoms of the coupler, in cyclic or acyclic form which together provide sufficient electron withdrawal to render H acidic and together provide sufficient ballast function to render the dye formed from the coupler immobile.

8. The element of claim 1, wherein said element is a photothermographic element.

9. The color photographic element of claim 1, wherein an imagewise exposed element is capable of being developed by heat treatment.

10. The color photographic element of claim 1, wherein an imagewise exposed element is capable of being developed by treatment with base either by contacting the element to a pH controlling solution or by contacting the element to a pH controlling laminate.

11. A light sensitive color photographic imaging element comprising a red-light-sensitive silver halide emulsion layer unit, a green-light-sensitive silver halide emulsion layer unit, and a blue-light-sensitive silver halide emulsion layer unit, wherein at least one light-sensitive layer unit has, in reactive association, a multifunctional coupler and a developer precursor liberating a developing agent enabling formation of a far infrared dye from the multifunctional coupler on development, wherein the multifunctional coupler has the property that it is capable of forming a distinctly colored near infrared dye with an oxidized form of the developer 4-(N-ethyl-N-2-hydroxyethyl)-2-methylphenylenediamine.

12. A light sensitive color photothermographic imaging element comprising a red-light-sensitive silver halide emulsion layer unit, a green-light-sensitive silver halide emulsion layer unit, and a blue-light-sensitive silver halide emulsion layer unit, wherein at least one light-sensitive layer unit has, in reactive association, a multifunctional coupler and a developer precursor liberating, upon heat treatment, a developing agent enabling formation of an infrared dye from the multifunctional coupler, wherein the multifunctional coupler has the property that it is capable of forming a distinctly colored cyan dye with an oxidized form of the developer 4-(N-ethyl-N-2-hydroxyethyl)-2-methylphenylenediamine.

13. A method of processing an imagewise exposed photographic element comprising developing the imagewise exposed element to form an image wherein said element comprises a red-light-sensitive silver halide emulsion layer unit, a green-light-sensitive silver halide emulsion layer unit, and a blue-light-sensitive silver halide emulsion layer unit, characterized in that at least one light-sensitive layer unit comprises an infrared dye that is the reaction product of element comprising a multifunctional coupler and a developing agent, wherein the multifunctional coupler has the property that it is capable of forming a distinctly colored cyan dye with an oxidized form of the developer 4-(N-ethyl-N-2-hydroxyethyl)-2-methylphenylenediamine.

14. The method according to claim 13 further comprising scanning the photographic element to form an electronic image representation.

15. The method according to claim 14 comprising the step of modifying a first electronic image representation formed from the imagewise exposed, developed, and scanned photographic element to form a second electronic image representation.

16. The method according to claim 14 comprising storing, transmitting, printing, or displaying an electronic image representation of an image derived from the imagewise exposed, developed, and scanned photographic element.

17. The method according to claim 16, wherein printing the image is accomplished by a printing technology selected from the group consisting of electrophotography; inkjet;

thermal dye sublimation; and CRT or LED printing to sensitized photographic paper.

18. The method according to claim 13 wherein the element is a photothermographic element.

19. The method according to claim 13 wherein the developing is accomplished in a dry state without the application of aqueous solutions.

20. The method according to claim 13 wherein the total amount of color masking coupler, the total amount of permanent Dmin adjusting dyes, and the permanent antihalation density, in blue, green and red density, is controlled so that the overall Dmin of the film minimizes the overall scanning noise during scanning.

21. A method according to claim 14 wherein said scanning occurs after partial desilvering of said element.

22. The method according to claim 13 wherein the developing is accomplished in by the contacting with an aqueous solution.

23. A method of processing an imagewise exposed photographic element comprising developing the imagewise exposed element to form an image wherein said element comprises a red-light-sensitive silver halide emulsion layer unit, a green-light-sensitive silver halide emulsion layer unit, and a blue-light-sensitive silver halide emulsion layer unit, characterized in that at least one light-sensitive layer unit comprises a far infrared dye that is the reaction product of element comprising a multifunctional coupler and a developing agent, wherein the multifunctional coupler has the property that it is capable of forming a distinctly colored near infrared dye with an oxidized form of the developer 4-(N-ethyl-N-2-hydroxyethyl)-2-methylphenylenediamine.

24. An image forming method comprising the step of scanning an imagewise exposed and developed photographic element wherein said element comprises a red-light-sensitive silver halide emulsion layer unit, a green-light-sensitive silver halide emulsion layer unit, and a blue-light-sensitive silver halide emulsion layer unit, characterized in that at least one light-sensitive layer unit comprises an infrared dye that is the reaction product of a multifunctional coupler and a developing agent, wherein the multifunctional coupler has the property that it is capable of forming a distinctly colored cyan dye with an oxidized form of the developer 4-(N-ethyl-N-2-hydroxyethyl)-2-methylphenylenediamine.

25. An image forming method comprising the step of scanning an imagewise exposed and developed photographic element wherein said element comprises a red-light-sensitive silver halide emulsion layer unit, a green-light-sensitive silver halide emulsion layer unit, and a blue-light-sensitive silver halide emulsion layer unit, characterized in that at least one light-sensitive layer unit comprises a far infrared dye that is the reaction product of a multifunctional coupler and a developing agent, wherein the multifunctional coupler has the property that it is capable of forming a distinctly colored near infrared dye with an oxidized form of the developer 4-(N-ethyl-N-2-hydroxyethyl)-2-methylphenylenediamine.

26. The element of claim 1 further comprising a base precursor.

27. The element of claim 26 wherein an imagewise exposed element is capable of being developed by contacting the element to a pH controlling solution or by contacting the element to a pH controlling laminate.

* * * * *